US011029002B1

(12) United States Patent
Demuynck

(10) Patent No.: US 11,029,002 B1
(45) Date of Patent: Jun. 8, 2021

(54) TOOLESS OPTIC COUPLINGS FOR LUMINAIRES

(71) Applicant: IDEAL INDUSTRIES LIGHTING LLC, Sycamore, IL (US)

(72) Inventor: Randolph C Demuynck, Wake Forest, NC (US)

(73) Assignee: IDEAL INDUSTRIES LIGHTING LLC, Sycamore, IL (US)

( * ) Notice: Subject to any disclaimer, the term of this patent is extended or adjusted under 35 U.S.C. 154(b) by 0 days.

(21) Appl. No.: 16/694,281

(22) Filed: Nov. 25, 2019

(51) Int. Cl.
*F21V 17/14* (2006.01)
*F21V 17/18* (2006.01)
*F21V 7/00* (2006.01)

(52) U.S. Cl.
CPC ..... *F21V 17/14* (2013.01); *F21V 17/18* (2013.01); *F21V 7/00* (2013.01)

(58) Field of Classification Search
CPC ..... F21V 17/005; F21V 17/10; F21V 17/14; F21V 17/18; F21V 7/00; F21V 7/04; F21V 7/06
See application file for complete search history.

(56) References Cited

U.S. PATENT DOCUMENTS 3,524,981 A * 8/1970 Auerbach ..... F21V 17/14 362/433
4,764,854 A * 8/1988 Matsune ..... F21S 41/194 362/649
4,982,313 A * 1/1991 Lupien ..... F21V 17/14 362/368
5,899,556 A * 5/1999 Ogawa ..... F21V 19/006 362/655
6,332,695 B1 * 12/2001 Wang ..... F21S 8/04 362/277
7,097,343 B2 * 8/2006 Tiesler-Wittig ..... F21S 41/192 362/651
7,988,336 B1 * 8/2011 Harbers ..... F21K 9/20 362/294
2009/0190361 A1 * 7/2009 Chung ..... F21V 21/088 362/341

(Continued)

FOREIGN PATENT DOCUMENTS

DE 2020130035348 * 6/2013 ..... F21V 17/002
DE 202013005348 U1 4/2020

OTHER PUBLICATIONS

English Machine Translation of DE 2020130035348 provided by ESPACENET (Year: 2013).*

(Continued)

*Primary Examiner* — Zheng Song
(74) *Attorney, Agent, or Firm* — J. Clinton Wimbish; Nexsen Pruet, PLLC

(57) ABSTRACT

Optic couplings, including optic retention rings, are described herein that require reduced tooling or no tooling for optic installation on luminaires. Briefly, a retention ring for coupling an optic to a luminaire comprises radial alignment assemblies comprising a base, and a protrusion extending from a surface of the base for engaging a coupling assembly of the optic. At least one radial locking assembly is offset from the radial alignment assemblies, the radial locking assembly comprising a vertical protrusion for engaging an aperture of the optic coupling assembly and locking rotation of the optic relative to the radial alignment assemblies.

20 Claims, 5 Drawing Sheets

(56) References Cited

U.S. PATENT DOCUMENTS

| | | | | |
|---|---|---|---|---|
| 2011/0267822 | A1* | 11/2011 | Harbers | F21K 9/20 362/249.03 |
| 2013/0051006 | A1* | 2/2013 | Speidel | F21V 11/00 362/235 |
| 2015/0078004 | A1* | 3/2015 | Harbers | F21K 9/64 362/293 |
| 2015/0276173 | A1* | 10/2015 | Vasta | F21V 5/08 362/294 |
| 2016/0069559 | A1* | 3/2016 | Harbers | F21V 7/06 362/294 |
| 2016/0201882 | A1* | 7/2016 | Liu | F21V 17/14 362/277 |
| 2018/0320875 | A1* | 11/2018 | Cho | F21V 29/763 |

OTHER PUBLICATIONS

International Searching Authority, "International Search Report and Written Opinion of PCT/US2020/061036", dated Jan. 4, 2021.

* cited by examiner

TOOLESS OPTIC COUPLINGS FOR LUMINAIRES

FIELD

The present invention relates to luminaires and associated optics and, in particular, to optic couplings which reduce or eliminate tooling requirements for optic installation on the luminaire.

BACKGROUND

Luminaire design is wide and varied depending on application and associated lighting characteristics. High bay luminaires, for example, often employ external reflecting or refracting optics for reducing glare and providing the desired lighting distribution to large areas, such as warehouse floors and other commercial spaces. These optics can be a shroud extending downward from the lighting assembly. Current luminaire design requires bolts or screws to couple an optic to the lighting assembly. This design is cumbersome, requiring correct placement of small screws through portions of the optic to engage the lighting assembly.

Additionally, this design requires tooling, such as a screwdriver, drill or other rotational tool, to lock the bolts or screws into place. In many cases, the optic is coupled to the lighting assembly after the lighting assembly has been mounted to a ceiling, thereby further complicating the correct placement and tightening of bolts and/or screws.

SUMMARY

In view of these disadvantages, optic couplings, including optic retention rings, are described herein that require reduced tooling or no tooling for optic installation on luminaires. Briefly, a retention ring for coupling an optic to a luminaire comprises radial alignment assemblies comprising a base, and a protrusion extending from a surface of the base for engaging a coupling assembly of the optic. At least one radial locking assembly is offset from the radial alignment assemblies, the radial locking assembly comprising a vertical protrusion for engaging an aperture of the optic coupling assembly and locking rotation of the optic relative to the radial alignment assemblies.

In another aspect, methods of coupling an optic to a lighting assembly of a luminaire are described. A method, in some embodiments, comprises coupling a retention ring to the lighting assembly, the retention ring comprising radial alignment assemblies including a base, and a protrusion extending from a surface of the base for engaging a coupling assembly of the optic. The retention ring also comprises at least one radial locking assembly offset from the radial alignment assemblies, the radial locking assembly comprising a vertical protrusion. The protrusions of the radial alignment assemblies are brought into engagement with slots of the optic coupling assembly, and the optic is rotated until the vertical protrusion of the locking assembly engages an aperture of the optic coupling assembly to lock rotation of the optic relative to the radial alignment assemblies.

In a further aspect, luminaires are described herein. A luminaire, in some embodiments, comprises a lighting assembly, and an optic coupled to the lighting assembly via a retention ring, the retention ring comprising radial alignment assemblies including a base, and a protrusion extending from a surface of the base and engaging a coupling assembly of the optic. The retention ring also comprises at least one radial locking assembly offset from the radial alignment assemblies, the radial locking assembly comprising a vertical protrusion engaging an aperture of the optic coupling assembly and locking rotation of the optic relative to the radial alignment assemblies.

These and other embodiments are further described in the following detailed description.

DETAILED DESCRIPTION

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

Figure 1:
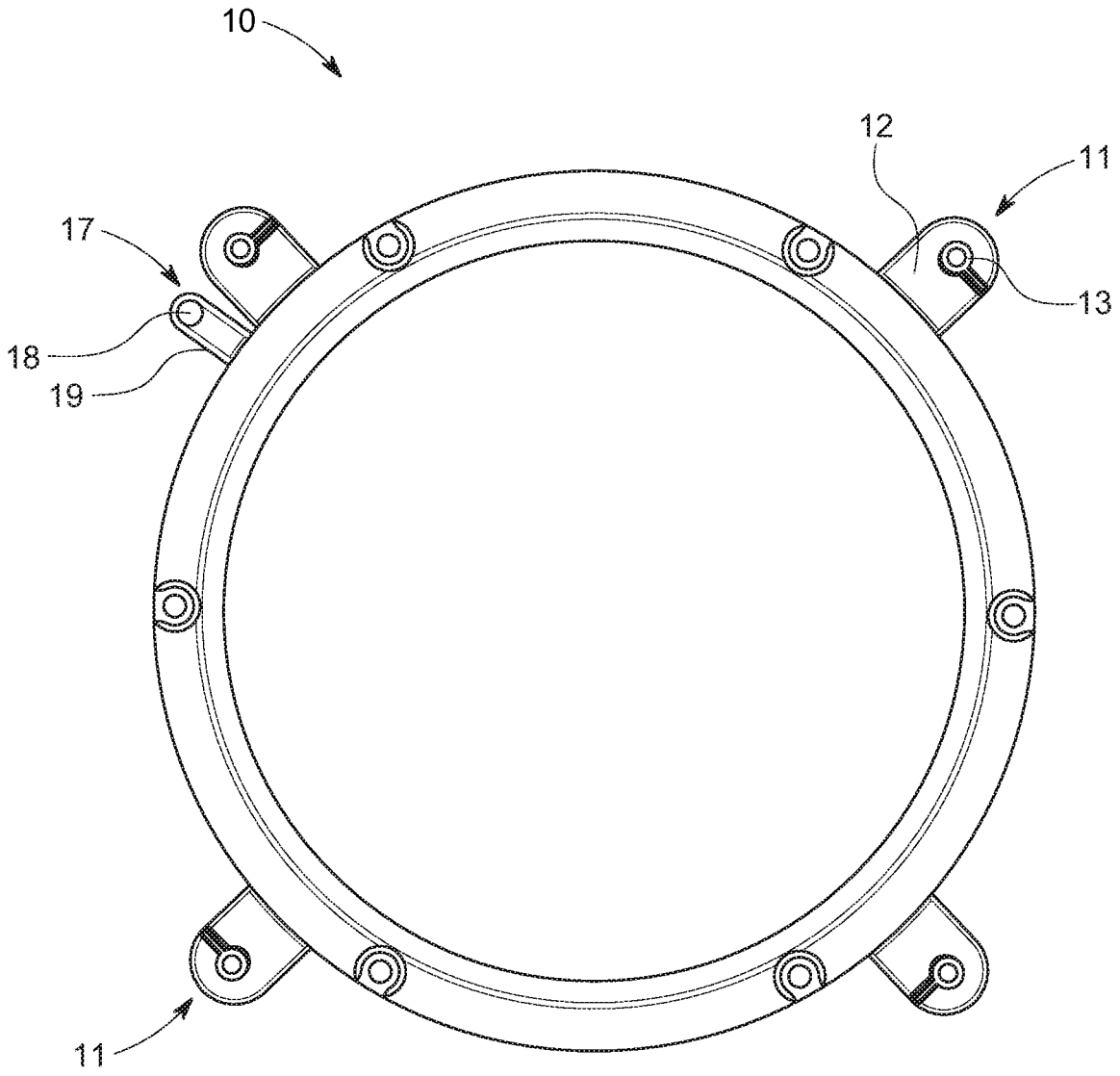
FIG. 1 illustrates a plan view of a retention ring described herein according to some embodiments.

FIG. 1 illustrates a plan view of a retention ring described herein according to some embodiments. As illustrated in FIG. 1, the retention ring 10 comprises radial alignment assemblies 11 comprising a base 12 and a protrusion 13 extending from a surface of the base 12 for engaging a coupling assembly of an optic. In the embodiment of FIG. 1, the radial alignment assemblies 11 have equal spacing or angular offset around the circumference of the retention ring 10. The radial alignment assemblies 11, for example, are offset from one another by 90 degrees. In other embodiments, the radial alignment assemblies 11 can have unequal spacing or unequal radial offset around the circumference of the retention ring 10. In the embodiment of FIG. 1, four radial alignment assemblies are shown. However, any desired number of radial alignment assemblies are contemplated.

Figure 2:
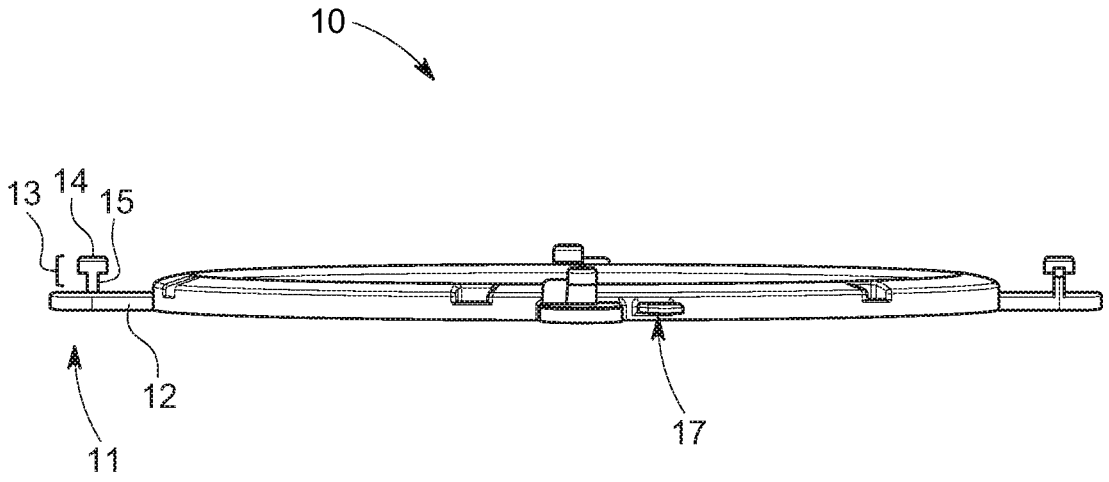
FIG. 2 is an elevational view of the retention ring of FIG. 1.
Figure 3:
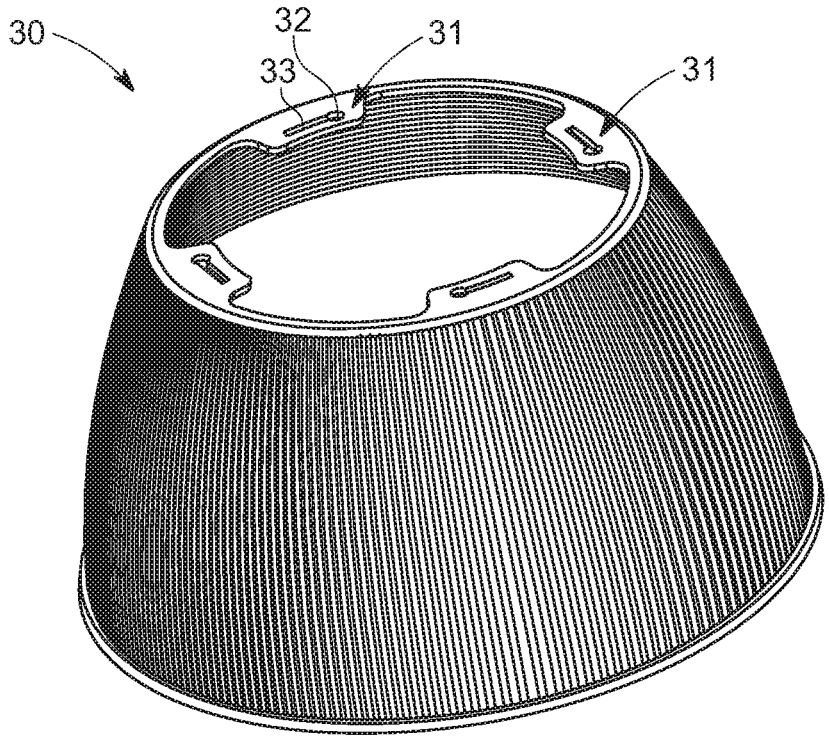
FIG. 3 illustrates a luminaire optic according to some embodiments.

FIG. 2 is an elevational view of the retention ring of FIG. 1. As illustrated in FIG. 2, the protrusion 13 of the radial alignment assemblies 11 comprises a head 14 coupled to a shaft 15, wherein the head 14 has a larger diameter than the shaft 15. This design can enable engagement of the protrusions 13 with slots of a coupling assembly on the optic. FIG. 3 illustrates a luminaire optic according to some embodiments. The optic 30 in FIG. 3 comprises four coupling assemblies 31 radially spaced around the circumference of the optic 30. As with the radial alignment assemblies of the retention ring, the coupling assemblies 31 can have equal or unequal spacing along the optic circumference. The optic coupling assemblies 31 generally exhibit the same radial spacing as the alignment assemblies 11 of the retention ring 10.

Figure 4:
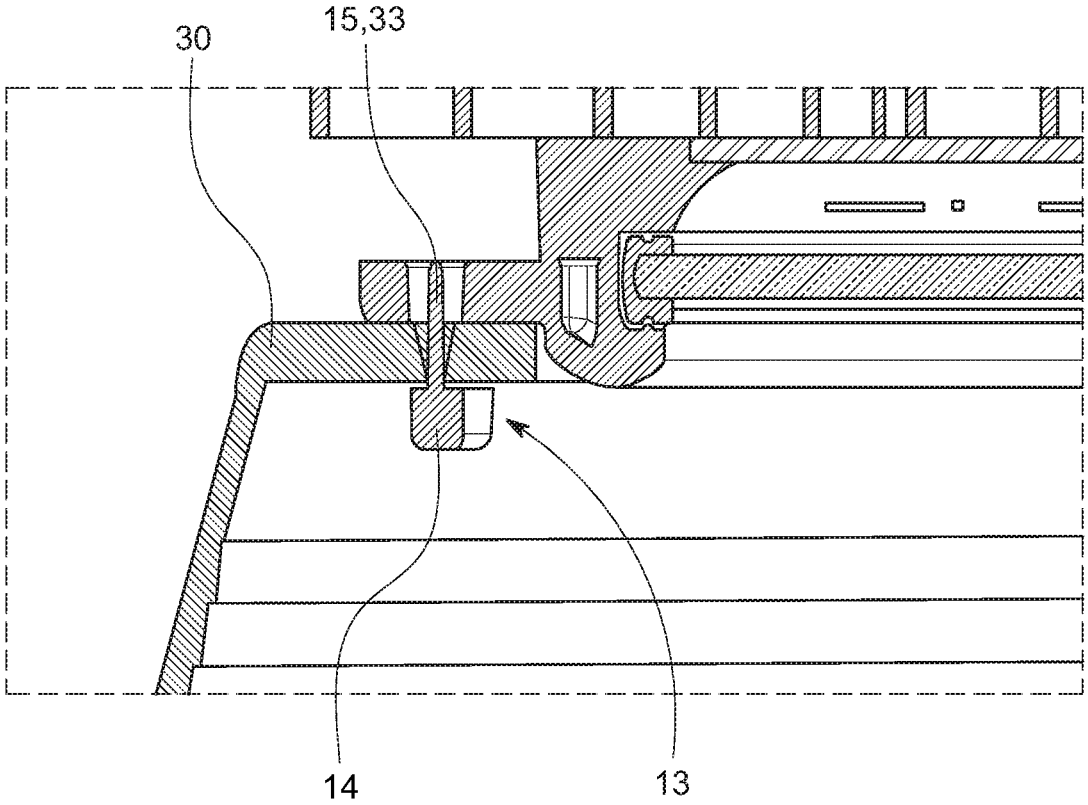
FIG. 4 illustrates a cross-sectional view of the protrusion engaging a coupling assembly of the optic according to some embodiments.

Each coupling assembly 31 comprises an aperture 32 and a slot 33 extending from the aperture 32. The head 14 of a protrusion 13 of a radial alignment assembly 11 can pass through the aperture 32 of the coupling assembly 31. The optic 30 is subsequently rotated, and the shaft 15 of the protrusion 13 passes into the slot 33 of the coupling assembly 31. In some embodiments, the shaft 15 can engage sidewalls of the slot 33. FIG. 4 illustrates a cross-sectional view of the protrusion 13 engaging a coupling assembly 31 of the optic 30 according to some embodiments. As described herein, the protrusion shaft 15 resides in the slot 33 of the optic coupling assembly 31. The larger diameter protrusion head 14 resides in the optic 30 interior and supports the optic 30.

Figure 5:
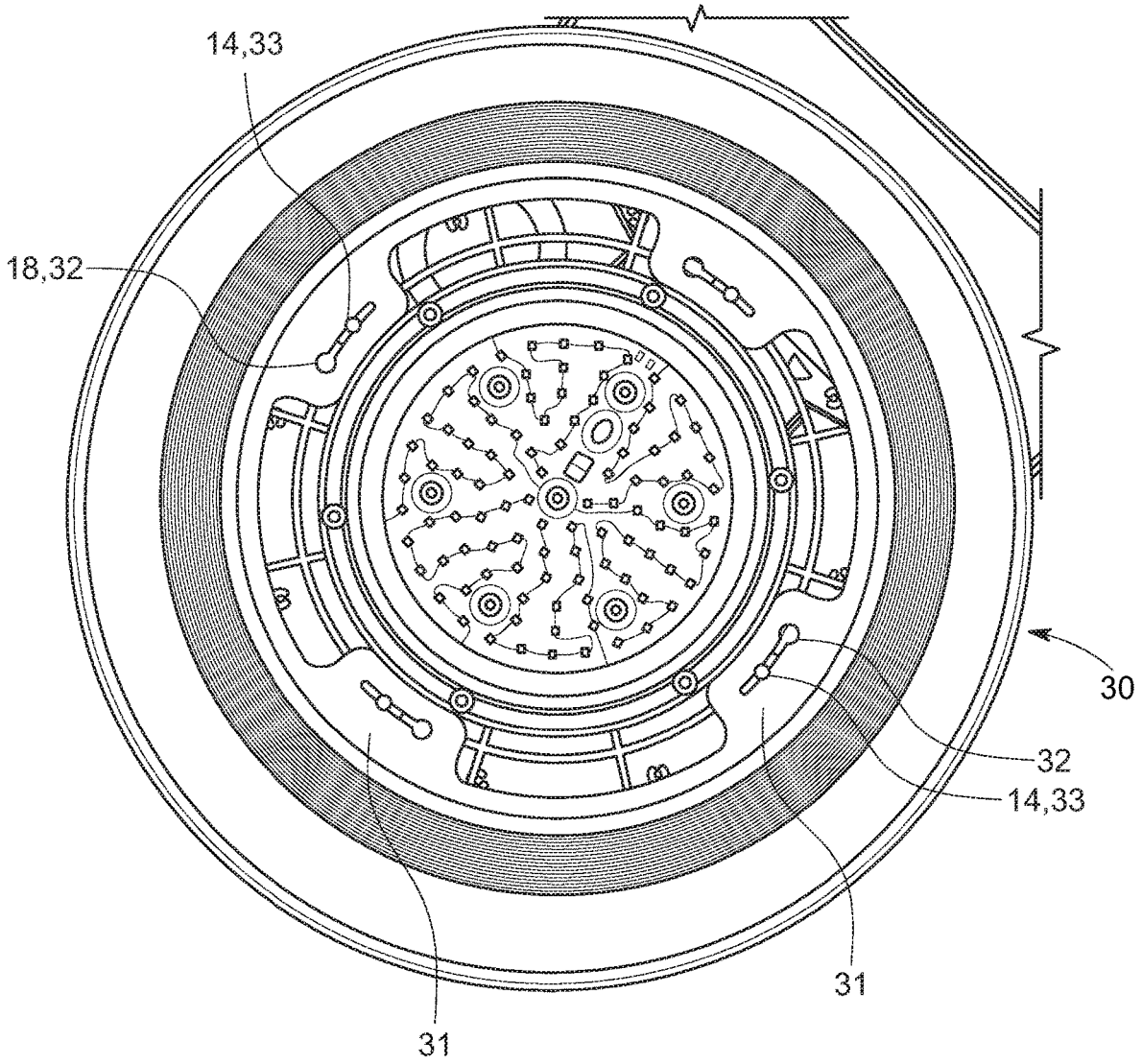
FIG. 5 illustrates a bottom plan view of an optic coupled to a lighting assembly of a luminaire according to some embodiments.

Referring once again to FIG. 1, the retention ring comprises at least one radial locking assembly 17 offset from the radial alignment assemblies 11. The radial locking assembly 17 comprises a vertical protrusion 18 for engaging an aperture 32 of the optic coupling assembly 30 and locking rotation of the optic 30 relative to the radial alignment assemblies 11. FIG. 5 illustrates a bottom plan view of an optic coupled to a lighting assembly of a luminaire according to some embodiments. In FIG. 5, protrusion heads 14 of the radial alignment assemblies 11 have passed through apertures 32 of the optic coupling assemblies 31, and the optic 30 has been rotated in a counter-clockwise direction to move the protrusions 13 into the slots 33 of the optic coupling assemblies 31. The optic 30 is further rotated in a counter-clockwise direction to position the vertical protrusion 18 of the locking assembly 17 in the aperture 32 of an optic coupling assembly 31. Positioning of the vertical protrusion 18 in the aperture 32 of the optic coupling assembly 31 locks rotation of the optic 30 relative to the radial alignment assemblies 11. The vertical protrusion 18 can be movable between the locked position in the aperture 32 and an unlocked position. A flange or tab 19 supporting the protrusion 18, for example, can be flexed or depressed to remove the protrusion 18 from the aperture 32, thereby freeing radial rotation of the optic 30 relative to the radial alignment assemblies 11. In this way, the optic 30 can be coupled to a luminaire via the retention ring 11 without the need for tooling, such as screwdrivers or other rotation tools. Accordingly, screws, bolts and/or other fastening mechanisms are also obviated.

The retention ring can be coupled to the luminaire at any location not inconsistent with the objectives and operating mechanisms described herein. In the embodiment of FIG. 5, the retention ring is coupled to the lighting assembly of the luminaire. In being coupled to the lighting assembly, the retention can have dimensions to preclude interference with light sources of the luminaire. The retention ring, for example, can have a diameter of sufficient dimension to encircle the light sources, such as light emitting diode (LED) sources. In being coupled to the lighting assembly, the retention ring can be coupled to the LED or light source array. Alternatively, the retention ring can be coupled to the heat sink and/or other structure of the lighting assembly.

In some embodiments, the retention ring further comprises a transparent cover overlaying the inner diameter of the retention ring. The transparent cover can be formed of any suitable material including glass or transparent polymeric materials. The cover, in some embodiments, can be used to protect and/or seal the light sources from the ambient environment. In other embodiments, the retention ring can be coupled to a heat sink assembly of the luminaire. Additionally, the retention ring can exhibit shapes other than a circle. Depending on design of the luminaire and/or optic, the retention ring can be elliptical, square, rectangular or other polygonal shape. Moreover, the optic coupled to the luminaire can be a reflective optic, refractive optic or an optic comprising reflective and refractive regions.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A retention ring for coupling an optic to a luminaire comprising: radial alignment assemblies extending outward from a base, and a protrusion extending from a surface of the radial alignment assemblies for engaging a coupling assembly of the optic; and at least one radial locking assembly offset from the radial alignment assemblies, the radial locking assembly comprising a flange extending radially outward from a circumference of the retention ring and a vertical protrusion extending from the flange for passing into an aperture of the optic coupling assembly and locking rotation of the optic relative to the radial alignment assemblies.

2. The retention ring of claim 1, wherein the protrusion of the radial alignment assemblies comprises a head coupled to a shaft of the protrusion, the head having a larger diameter than the shaft.

3. The retention ring of claim 1, wherein the radial alignment assemblies are equally spaced over a circumference of the base of the retention ring.

4. The retention ring of claim 1, wherein the radial alignment assemblies are unequally spaced over a circumference of the base of the retention ring.

5. The retention ring of claim 1, wherein the vertical protrusion is movable between a locked and unlocked position.

6. The retention ring of claim 5, wherein the flange is flexed when the vertical protrusion assumes the unlocked position.

7. The retention ring of claim 1, further comprising one or more apertures formed in the coupling assembly of the optic for receiving fasteners for coupling the retention ring to the luminaire.

8. The retention ring of claim 1 further comprising a transparent cover overlaying an inner diameter of the retention ring.

9. The retention ring of claim 1, the base having sufficient diameter to encircle light sources of the luminaire.

10. A luminaire comprising: a lighting assembly, and an optic coupled to the lighting assembly via a retention ring, the retention ring comprising: radial alignment assemblies extending outward from a base, and a protrusion extending from a surface of the radial alignment assemblies and engaging a coupling assembly of the optic; and at least one radial locking assembly offset from the radial alignment assemblies, the radial locking assembly comprising a flange extending radially outward from a circumference of the retention ring and a vertical protrusion extending from the flange and passing into an aperture of the optic coupling assembly and locking rotation of the optic relative to the radial alignment assemblies.

11. The luminaire of claim 10, wherein the optic coupling assembly comprises slots for receiving the protrusions of the radial alignment assemblies.

12. The luminaire of claim 10, wherein the retention ring is coupled to the lighting assembly.

13. The luminaire of claim 12, wherein the retention ring is coupled to a heat sink of the lighting assembly.

14. The luminaire of claim 12, wherein the optic coupling assembly further comprises apertures for receiving fasteners for coupling the retention ring to the lighting assembly.

15. The luminaire of claim 10, wherein the radial alignment assemblies are equally spaced over a circumference of the base of the retention ring.

16. The luminaire of claim 10, wherein the vertical protrusion is movable between a locked and unlocked position.

17. The luminaire of claim 10, wherein the lighting assembly comprises an LED assembly.

18. The luminaire of claim 17, wherein the retention ring has a diameter exceeding diameter of the LED assembly.

19. The luminaire of claim 17, wherein the retention ring further comprises a transparent cover overlaying the LED assembly.

20. A method of coupling an optic to a lighting assembly of a luminaire comprising: coupling a retention ring to the lighting assembly, the retention ring comprising radial alignment assemblies extending outward from a base, and a protrusion extending from a surface of the radial alignment assemblies for engaging a coupling assembly of the optic, and at least one radial locking assembly offset from the radial alignment assemblies, the radial locking assembly comprising a flange extending radially outward from a circumference of the retention ring and a vertical protrusion extending from the flange; engaging the protrusions of the radial alignment assemblies with slots of the optic coupling assembly; and rotating the optic until the vertical protrusion of the locking assembly passes into an aperture of the optic coupling assembly to lock rotation of the optic relative to the radial alignment assemblies.

* * * * *